United States Patent [19]

Frank

[11] Patent Number: 4,649,376

[45] Date of Patent: Mar. 10, 1987

[54] VISUAL FIRE ALARM APPARATUS

[76] Inventor: Richard Frank, 740 East Baypoint Rd., Milwaukee, Wis. 53217

[21] Appl. No.: 622,070

[22] Filed: Jun. 19, 1984

[51] Int. Cl.[4] ..... G08B 17/10

[52] U.S. Cl. ..... 340/691; 340/693

[58] Field of Search ..... 340/691, 693

[56] References Cited

U.S. PATENT DOCUMENTS 4,283,657 8/1981 Gordon et al. ..... 340/691

4,422,069 12/1983 Edströhm et al. ..... 340/691

*Primary Examiner*—Glen R. Swann, III

*Attorney, Agent, or Firm*—Andrus, Sceales, Starke & Sawall

[57] ABSTRACT

A smoke alarm system has a smoke detector mounted to the ceiling of enclosure. The detector has audible and visual alarms. Special high intensity lamp units are mounted in remote relationship to the detector such as immediately adjacent to the opposite sides of an exit door and located to create a beam significantly below the normal smoke level at even advanced stages of combustion. The lamp units are coupled to the detector and operated thereby. The high intensity lamp units include a small battery driven Xenon lamp presently used for flash camera illumination and are activated to produce high intensity light bursts at a frequency such that the pulses are readily distinguishable but are sufficiently close to insure seeing by a person's rapid review of the environment. A tubular lamp is mounted on an electronic circuit board with an inverted U-shaped reflector and an outer plastic shell. The detector and lamp units are formed of extruded plastic bases, covers and end walls and having a battery recess in an end wall of the detector. The detector may be wired to the lamp units with special closed, wall-mounted channels. The channels are extruded plastic housing having a snap cover structure and a special internal recess construction for connection of adjacent members by a removable tab.

10 Claims, 10 Drawing Figures

VISUAL FIRE ALARM APPARATUS

BACKGROUND OF THE PRESENT INVENTION

This invention relates to visual fire alarm apparatus and particularly to such apparatus which provides visual display under high smoke conditions.

With advances in electronic circuitry and combustion product sensors, significant developments have been made in the production of fire and smoke detection devices. The more recent sensors respond to the particulate generated by combustion, thereby providing a more rapid response to a fire. Further, such sensors have been produced at relatively low cost. Thus, individual fire alarm devices which are battery operated can be purchased for as little as $10.00 a unit retail. As a result, such fire alarm devices are widely used. In fact many governmental units have enacted rules, regulations and laws requiring the installation of such units in various public, institutional and rental properties such as multiple family dwellings. Generally, such fire alarm devices include some form of a smoke or other combustion product sensor in combination with a suitable audible alarm. In addition, certain units incorporate certain auxiliary visual indicators including a visual indication and other status and test lights. For example, U.S. Pat. No. 4,148,023 discloses a smoke alarm with the conventional audible alarm in combination with a lamp incorporated directly into the unit to provide a visual indication of the alarm status. U.S. Pat. No. 4,258,359 also discloses a smoke alarm device having a lamp unit connected by a cord and adapted to be mounted in relation to the sensor and audible alarm.

Although such alarm installations have been credited with the saving of many lives, there remain many instances of fires which have killed a substantial number of people because of the confusion associated with fires. Thus, it is well-known that the smoke and gases associated with a fire are generally the actual cause of death associated with a fire. Many people are overcome by the smoke before they can find an appropriate exit from the enclosure within which they are trapped. Thus, an audible alarm of the conventional fire alarm unit may not provide the necessary directional help. Obviously under ideal conditions and in the absence of confusion, one can trace the sound of the alarm. Apparently, the high state of confusion in the presence of a fire requires some further device or means. Visual devices such as heretofore suggested, have not apparently been constructed to provide the necessary additional means operable in the confusion associated with a fire in that the directional relationships and effects of existing devices appear significantly inadequate.

As a result of the existing difficulties and problems associated with the confusion associated with fires there remains a very obvious and significant need for an improved directional means for leading a person under a state of high confusion from a fire location.

SUMMARY OF THE PRESENT INVENTION

The present invention is particularly directed to a smoke alarm system having visual means properly constructed and arranged to produce maximum visual direction to persons trapped by a fire within an enclosure. Generally, in accordance with the teaching of the present invention, a smoke alarm detector is provided and appropriately mounted at or adjacent to a ceiling. The alarm unit preferably incorporates a suitable audible alarm and may include the conventional visual alarms heretofore suggested. In accordance with the teaching of the present invention, special high intensity lamp units are mounted in remote relationship to such detector unit so as to locate a high intensity light source significantly below the normal smoke level at even advanced stages of combustion, and are suitably connected as by elongated cable means to the sensing detector unit for actuation in response to a fire. The lamp units may also be coupled to the sensing detector unit by a radio signal emitted from the detector in an alarm condition. The high intensity lamp units are specially constructed to produce high intensity light bursts at a frequency such that the pulses are readily distinguishable but are sufficiently close as to avoid any possibility that the illumination would be missed by a person's rapid review of the environment. Although the alarm detector unit may be of any suitable construction, the visual light units are preferably a small battery driven system high intensity lamp such as the small Xenon lamp presently used for flash camera illumination. The tubular lamp is mounted on an electronic circuit board with an inverted U-shaped reflector. The circuit board and lamp are housed within a suitable enclosure having an outer plastic shell. The high intensity lamp unit is conveniently mounted on the wall of the enclosure immediately adjacent to an exit door, with a separate lamp unit provided to each side of the exit door.

The smoke detector and the visual alarms are in one practical construction specially formed from extruded plastic bases and covers. The end walls have a snap connection to a base. A U-shape top wall telescopes over the base to define the complete enclosure of the sensor and associated electronic circuitry. The detector can be formed of end walls having the edges spaced from the cover for entrance of the environment. The power battery is conveniently housed in a socket or recess integrally formed in one of the end walls. Similarly, the high intensity light units consist of an extruded base in combination with extruded end walls and extruded U-shaped cover. The end walls are preferably sealed to the base and to the cover to form a sealed enclosure of the light and associated circuitry. The high intensity lamp is coupled to the detector and thus to the battery for power. The lamp is also connected in circuit for energization in response to the actuation of the smoke detector.

The high intensity lights with the pulse energization creates an extremely visible state even under highly intense smoke conditions. The high intensity light unit can even provide a visual direction around an obstruction or corner in a structure or the like. Thus, a person trapped in a fire environment would normally drop to the floor and in doing so locate himself in an area of maximum illumination of the high intensity lamps constructed and arranged in accordance with the present invention. Although it is possible that as a fire reaches its maximum state, of smoke generation, the smoke may be such as to positively prevent any visual transmission of light, the high intensity lamp provide a highly effective and practical response in which maximum efficiency of operation is provided under practical specifications.

The wiring preferably, of course, is of low voltage and may be incorporated in an extruded plastic wall-mounted and closed channels. Where the cable is placed on an exposed wall surface, a special enclosure is desired to protect against possible accidental engagement and damaging of the wire. In accordance with a further aspect of this invention, an extruded plastic housing is provided having a snap cover structure. The unit includes a special internal channel construction permitting the interconnection of adjacent members by a simple removable tab. Such a molded plastic channel provides simple, readily applied and relatively low cost wiring for the visual alarm lamp units to permit low cost manufacture and installation.

The present invention with the high intensity lamp units properly located in the lower regions of the enclosure provides a simple but highly reliable and effective visual alarm which will provide a directional signaling to those within an enclosure under fire conditions.

DESCRIPTION OF THE DRAWING FIGURES

The accompanying drawings illustrate the best mode presently contemplated by the inventor for carrying out the invention.

DESCRIPTION OF THE ILLUSTRATED EMBODIMENT

Figure 1:
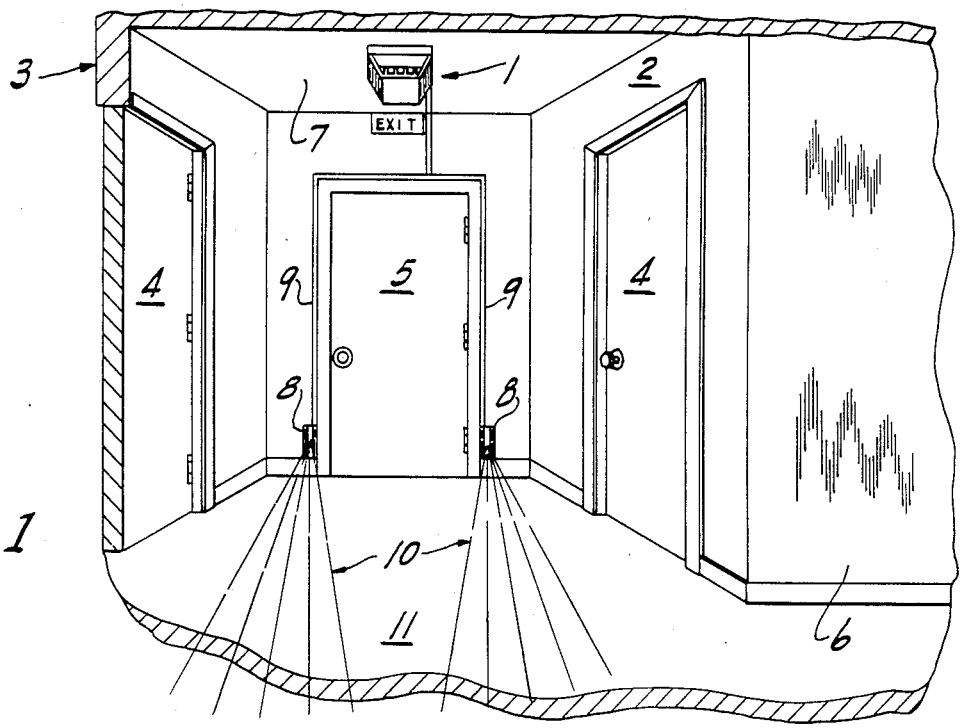
FIG. 1 is a pictorial illustration of an application of the present invention.

Referring to the drawings and particularly to FIG. 1, a smoke detector unit 1 is shown mounted in the hallway 2 of a building enclosure 3. The hallway 2 includes a number of entrance doors 4 and a main exit door 5. In the illustrated embodiment of the invention, an angled hallway 6 is shown extending from the main hallway 2 and defining a corner or intersection. The exit door 5 cannot be directly viewed or seen from hallway 6. The smoke detector unit 1 is shown mounted to the ceiling 7 immediately adjacent to the exit door 5. In the event of a fire, the products of combustion accummulate in the upper region of the hallways 2 and 6 including the exit door 5. The detector unit 1 responds to such condition to generate an audible alarm, thereby alerting the occupants of the fire hazard. The audible alarm provides a convenient and reliable initial alarm means to the occupants but may not provide a convenient and reliable directional means for directing occupants to the exit door 5. In accordance with the present invention, special high intensity lamps units 8 are secured within the hallway 2, and are specially located in the lower region of the hallway 2 and particularly adjacent exit door 5 in the illustrated embodiment of the invention. A pair of high intensity lamp units 8 are shown and mounted one each to the opposite side of the exit door 5. The lamp units 8 are connected by similar low voltage wiring cables 9 to the smoke detector unit 1. When the smoke detector unit 1 actuates the audible alarm, a low voltage circuit connection to the lamp units 8 is also completed. Each of the lamp units 8 is similarly constructed to generate a pulsed, high intensity light beam 10. With the units 8 mounted in the lower region of the hallway 2 and in particular below the normal waist level of the occupants and thus adjacent to the floor 11 rather than the ceiling 7, the high intensity lamp units are in an area of minimum smoke. The light bursts therefore penetrate a substantial distance throughout the hallways 2 and 6. The light beam 10 will be visible from the adjacent hallway 6 and maintain a very satisfactory directional means for leading the occupants to exit door 5. In case of fire, it is wellknown that one should drop to and move along the floor 11. This is almost a natural reaction in view of the reaction to the smoke in the upper regions. Thus, the combination of the audible signal and the light beams even if only available during the initial stage of combustion produces maximum directional information to the occupant, thereby facilitating and promoting rapid and efficient exiting from the building.

Further, the conventional battery driven detector has a low-battery state detector built into the circuit to activate a short beep on the smoke detector at approximately 30 second intervals. This circuit may be connected to and also drive the lamp unit 8.

Figure 2:
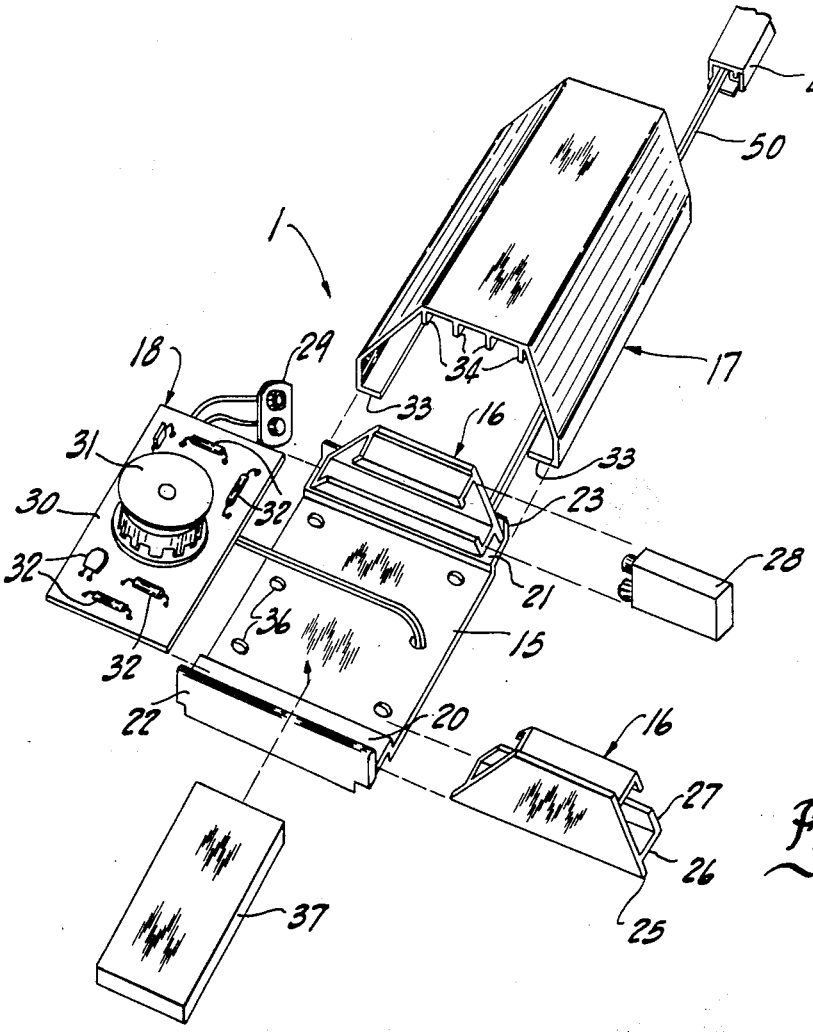
FIG. 2 is an enlarged exploded view of the smoke detector unit illustrated in FIG. 1.
Figure 3:
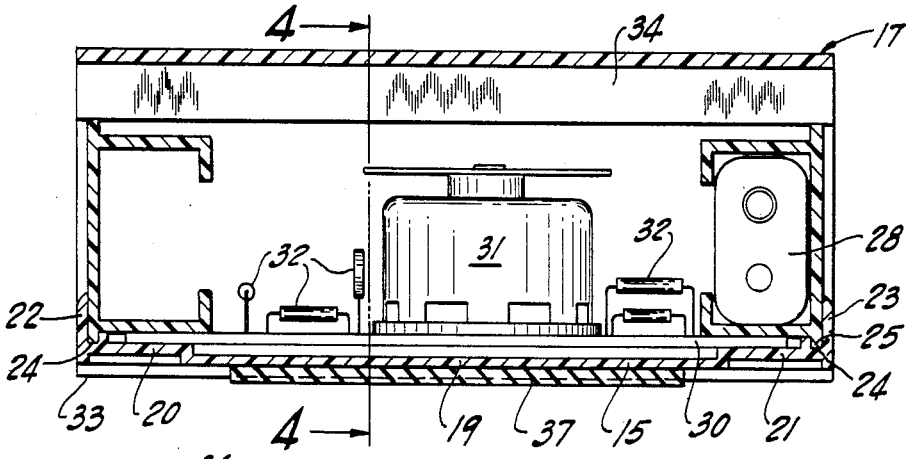
FIG. 3 is an enlarged longitudinal section through the smoke detector shown in FIGS. 1 and 2.
Figure 4:
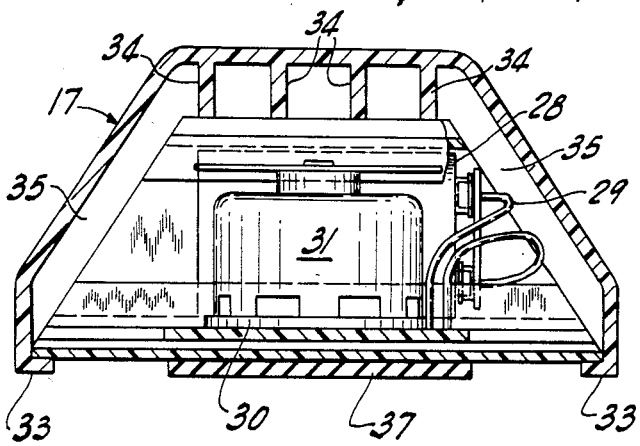
FIG. 4 is a cross sectional end view of the smoke detector taken on line 4—4 of FIG. 3.

Although the smoke detector unit 1 can be of any known or suitable construction, a particularly practical and low cost unit is illustated in FIGS. 1-4. Referring particularly to FIGS. 2-4. the smoke detector unit 1 includes a plate-like mounting base 15 of substantially rectangular construction. The base 15 is formed of an extruded plastic or other suitable material having various offset surfaces, presently described, for releasable interconnection to a pair of similar end walls 16 and an outer cover 17 defining a substantial enclosure of a smoke detector circuit board assembly 18. The end walls 16 are formed from an extruded channel member as is cover 17.

As shown most clearly in FIGS. 3 and 4, the base 15 is a generally flat rectangular member which can be formed as a continuous extruded plastic member and cut to the proper length for each individual unit. The base 15 is formed with a central depression 19 extending throughout the substantial length of the base and defining end ledges 20-21. The outermost edge portions of the base 15 are formed with spaced upstanding flanges or walls 22-23 defining a transverse slot 24. The end wall units 16 are specially formed channels with a depending edge or tab 25 which fits in the slot of recesses 24 formed by walls 22-23 of the base 15 (See FIG. 3). The depending tab 25 is slightly longer than the inner walls of the recesses and locates a horizontal wall 26 of the end wall spaced slightly from the adjacent base ledge 20, or 21 to define a circuit board locating slot or recess as hereinafter discusssed. The end wall units 16 are similar U-channel shaped members with the outer wall forming the base and end channel walls extending inwardly and terminates in inwardly extended lips 27 defining a reduced opening into the channel. The inner cross-section of the channel corresponds to the exterior cross section of a conventional 9 volt dry cell 28, which is adapted to be supported therein with a releasable pressure fit. The length of the channel is slightly greater than the length of the battery 9 to hold the battery in place and with the circuit leads and connector assembly 29 from circuit board 18 releasably coupled to the batteries 28 in the usual connection.

The end wall units 16 are specially formed with a generally trapazoidal configuration for esthetic purposes, and are correspondingly assembled to the base 15 and thus defines the pair of opposite and opposed recesses adjacent the ledges 20–21 of base 15. The detector circuit board unit 18 includes the usual printed circuit board construction with a circuit board 30 of a thickness generally corresponding to the depth of the opposed recesses. The opposite ends of the circuit board 30 are constrained between the base ledges 20–21 and the overlying end wall flanges. A smoke detector element 31 is secured to the board 30 with the associated electronic and drive circuitry and components 32 secured thereto. The various elements are connected into an operating circuit adapted to be driven from a 9 volt source such as battery 28.

The outer cover 17 is an inverted U-shaped cover member shaped generally to the configuration of the end walls. The opposed edges of the cover 17 include inwardly projecting lips 33 adapted to engage the underside of the plate base 15, as shown in FIG. 4. The outer wall of the cover 17 is a flat wall overlying the end walls. A plurality of depending walls 34 engages the upper end of the end walls and with lips establish a slight pressure fit of the cover 17 in place. The dimensional relationship of the several components is thus such as to provide a slight pressure connection providing a firm mechanical interconnection of the several parts. The outer wall of the cover extends outwardly along the corresponding edge of the end wall. A free space 35 is thereby formed beween the inclined side walls, the outer wall and the edges of the end wall unit for free entrance of the environment into the alarm unit and particularly into the area of the sensing element 31.

The base 15 is provided with suitable mounting means, shown as mounting openings 36 for physical attachment to the wall by suitable screws and a mounting pad 37 secured to the back side of the base. The pad 37 includes an adhesive mounting face for appropriate mounting of the detector unit.

Figure 5:
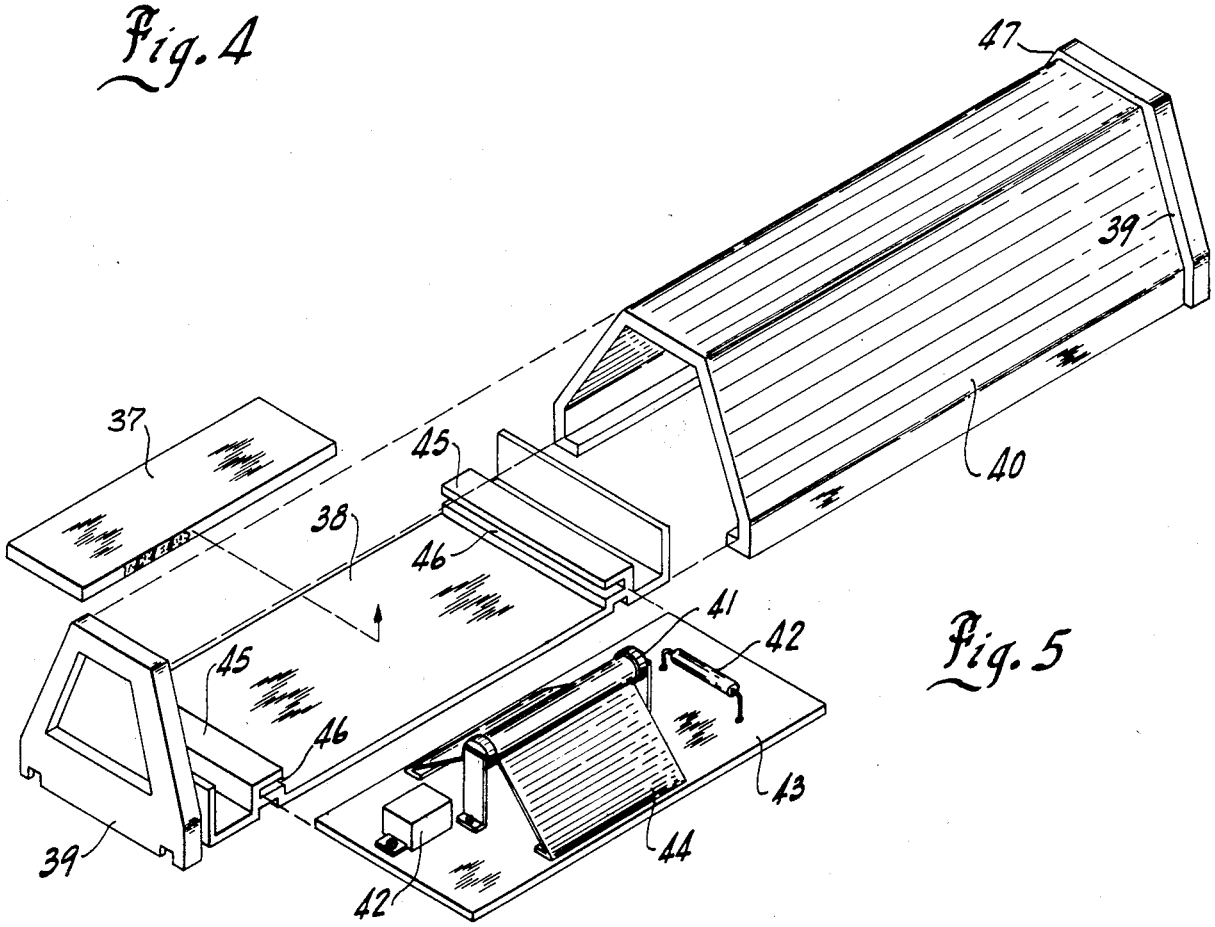
FIG. 5 is an enlarged pictorial view of the lamp unit shown in FIG. 1.
Figure 6:
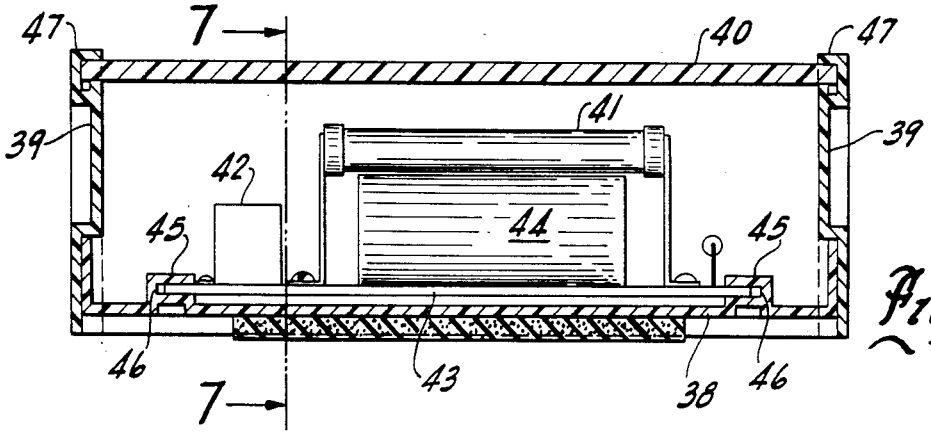
FIG. 6 is a longitudinal section view of the lamp units shown in FIGS. 1-5.
Figure 7:
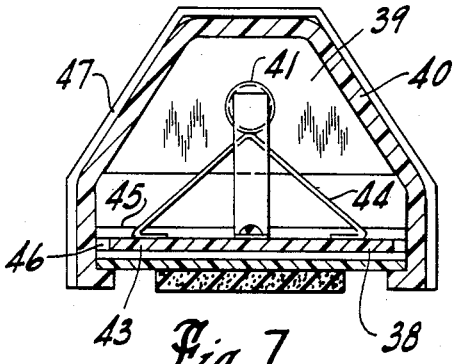
FIG. 7 is a transverse section taken on line 7—7 of FIG. 6.

The light units 8 are shown as identical units including a generally trapazoidal configuration. Each light unit, as shown in FIGS. 5–7, also consists of an extruded plastic base 38, similar opposed end walls 39 and an outer inverted U-shaped cover 40. A high intensity lamp 41 along with a pulse drive circuit 42 is secured to a circuit board 43 which is suitably affixed to the base 38. A special U-shaped reflector 44 is secured to the base beneath the lamp and creates an improved dispersion of the light beam.

More particularly, the base member 38 is preferably formed of an elongated extruded member which is severed to the desired width for forming a light base. The extruded base member is formed with a pair of similar offset internal laterally opening C-members 45 spaced from each and defining laterally opening and opposed slots 46. The circuit board 43 slips into the slots 46 to provide a mounting for the circuit board. The end walls 39 are simple dished members having edge flanges 47. Each end wall 39 is secured abutting the end of the base with the flange 47 telescoped over the end of the outer cover 40.

The outer cover 40 is an extruded plastic member of a generally U-shaped configuration and formed of a suitable light transmitting material. The cover is preferably formed of a colored plastic such as green, amber or red plastic depending upon the local code requirements and the optimum warning color desired.

The light units 8 are preferably formed as a sealed unit with the end walls 39 adhesively or otherwise bonded to the base 38 and to the cover 40.

Figure 8:
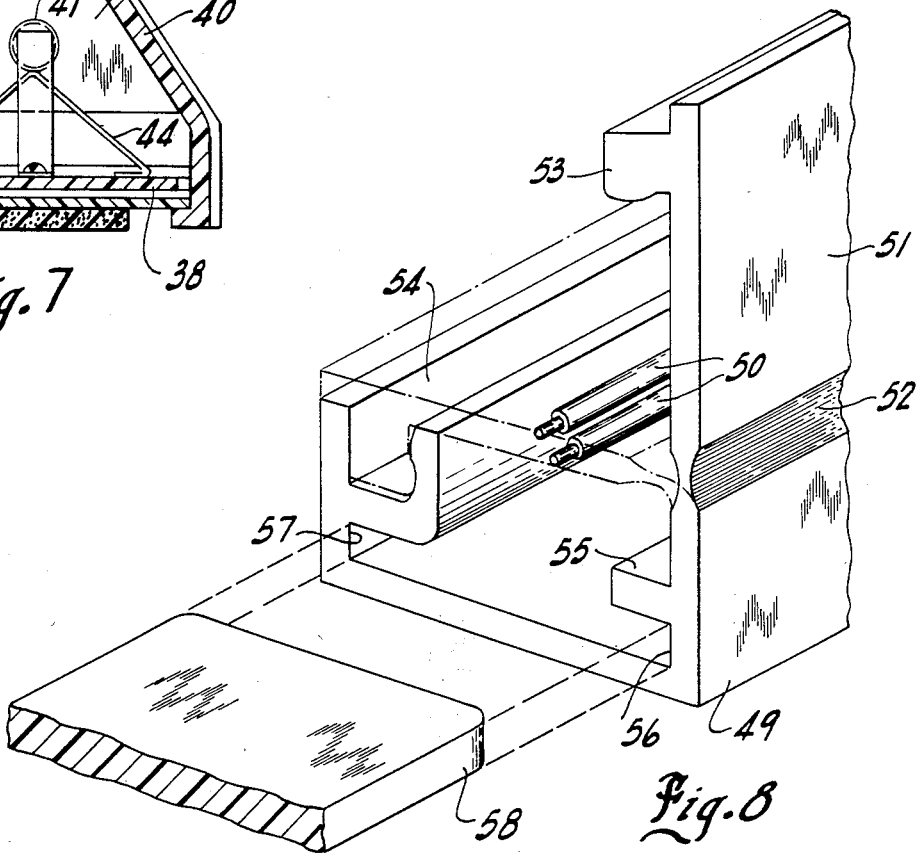
FIG. 8 is an exploded pictorial view of one lamp connector cable unit shown in FIG. 1 and having a protective cable housing.
Figure 9:
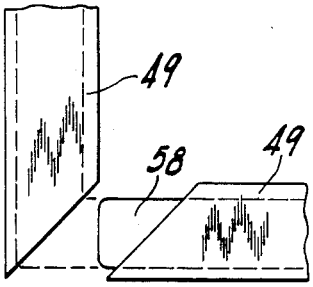
FIG. 9 is a plan view showing a corner connection of the cable housing.
Figure 10:
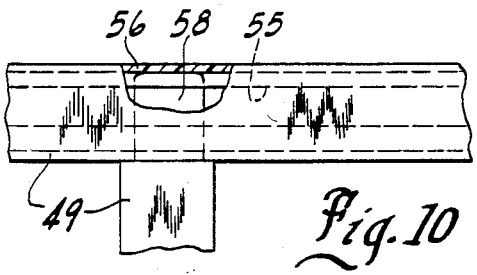
FIG. 10 is a plan view showing a T-connector of the cable housing.

Although any suitable low voltage wiring system may be used, a practical and novel wiring system is illustrated in the drawings and particularly FIGS. 8–10. An outer insulating conduit 49 is formed as a single piece extruded plastic member. Low voltage wires 50 are housed within the plastic conduit 49 to protect the wires from accidental or intentional destruction. The single piece conduit is shown with a generally rectangular configuration for convenient wall mounting, either by suitable mounting screws or a suitable adhesive interposed between the unit and the wall. The channel is formed with an outer movable wall cover 51 integrally formed with one side wall as by a thinned hinged joint unit 52. The free edge of the wall cover and the mating edge of the opposite side wall is formed as a slot and tab connector. In the illustrated embodiment the edge of the cover 51 includes a depending tab 53 adapted to releasably snap into edge recess or slot 54 in the side wall, as shown in phantom in FIG. 8. The inner base of the channel is further formed with a ledge 55 on the hinged wall to define a slot 56 extending throughout the length of the conduit 49. The slot wall for the cover connection is spaced from the conduit base to form a second slot 57 similar to slot 56. A coupling tab 58 in the form of a flat strip is constructed to provide a pressure fit within the slots 56–57. The tab 58 bridges the joint between abutting channels to form a firm interconnection therebetween. In practice, the conduit can be made of a standard length. In assembly of the wiring of the system, the conduits are formed with abutting joints at various connections, such as end-to-end lengths and corners. The end-to-end connection of conduit is made by a tab projecting into the abutting conduits. A side joint or connection is similarly made with a tab projecting from the end of one conduit into the side of the adjacent conduit beneath slot 56. A corner connection is made by forming the conduits with a 45 degree or other appropriate end with a tab again budging the connection. A series of conduits are mounted in abutting relationship and at the detector and lamp units. The wiring system shown is particularly useful for home installation and any other wiring system suitable for the low current and voltage encountered in the system described.

The present invention thus provides a significant improvement in the field of fire alarm systems and in the preferred aspects of the invention, a particularly satisfactory construction for the commercial implementation of the construction and installation of the system.

Various modes of carrying out the invention are contemplated as being within the scope of the following claims and particularly pointing out and distinctly claiming the subject matter which is regarded as the invention.

I claim:

1. A smoke alarm system, comprising a portable visual means having an outer housing having a back portion and a forward flat wall portion and inclined sidewalls to establish maximum forward projection of light to persons trapped by a fire within an enclosure, a smoke alarm detector mounted adjacent an upper portion of the enclosure, low voltage lead means connecting said alarm detector to actuate said visual means, said visual means including a high intensity lamp unit, said visual means being mounted in remote relationship to such detector unit so as to locate the high intensity light below the normal smoke level within the enclosure at advanced stages of combustion, a support unit within said housing for said visual means, a pulsed power supply means mounted to said support unit and connected to create bursts of light from said high intensity lamp unit at a frequency such that the pulses are readily distinguishable but are sufficiently close as to avoid any possibility that the illumination would be missed by a person's rapid review of the environment, and a low voltage D.C. battery means mounted on said support unit and connected to operate said supply means and said lamp unit.

2. The system of claim 1 wherein said lamp unit includes a small xenon tubular lamp.

3. The system of claim 1 wherein said housing is an extruded plastic wall-mounted and closed channel having an end wall with a channel-shape cross-section opening corresponding to said battery means, said battery means being releasably located in said opening.

4. The alarm system of claim 1 wherein said support unit includes a plate-like mounting based of substantially rectangular construction, said base being formed of an extruded plastic and having spaced offset surfaces, a pair of similar opoosite end walls secured to said base by a slot and projection connection, an outer cover, and means connecting said cover to said base and having interlocking means with said end walls to support the end walls in place.

5. The system of claim 4 wherein said base includes a central depression extending throughout the length of the base defining end ledges, and having upstanding end flanges defining a transverse slot, said end wall having a channel with a depending tab mating with said slot, said end wall having a horizontal wall spaced slightly from the adjacent base to define a circuit board locating recess, and a circuit board having opposite ends disposed one in the circuit board locating recess of each end wall.

6. The system of claim 5 wherein said channel has an inner cross section corresponding to the exterior cross section of a conventional 9 volt dry cell 28.

7. The alarm system of claim 6 wherein said end walls have a generally trapazoidal configuration, said outer cover 17 is an inverted U-shaped cover member shaped generally to the configuration of the end walls, said cover having an inwardly projecting lip on each longitudinal edge adapted to engage the base 15 to frictionally grip the base and create a slight pressure connection to the base and end walls for providing a firm mechanical interconnection of the several parts.

8. The system of claim 7 wherein a plurality of depending walls on said cover engage the upper end of the end wall to define a free space between the cover and the edges of the end walls for free entrance of the environment into the alarm unit.

9. The system of claim 1 wherein the light unit includes a plastic base and similar opposed end walls secured to the base, an outer inverted U-shaped cover, an inverted U-shaped reflector secured to said base, said lamp unit including a high intensity lamp secured to said base and extending over the center of the reflector to create an improved dispersion of the light beam, and means to secure said pulsed power supply means to said base.

10. The system of claim 9 wherein said base is formed as a plate having a pair of similar offset internal laterally opening C-members spaced from each and defining laterally opening and opposed slots, a circuit board having edges located in said slots to mount the circuit board, said reflector and said lamp and said pulsed power supply means being mounted on said circuit board, said end walls including dished members having edge flanges and secured abutting the end of the base with the flange telescoped onto the outer cover.

* * * * *